US008553156B2

(12) United States Patent
Hsi et al.

(10) Patent No.: US 8,553,156 B2
(45) Date of Patent: Oct. 8, 2013

(54) HDMI AND VGA COMPATIBLE INTERFACE CIRCUIT

(75) Inventors: Mao-Shun Hsi, New Taipei (TW); Yau-Shi Hwang, New Taipei (TW); Chih-Hao Chang, New Taipei (TW); Chung-Chih Chou, New Taipei (TW); Po-Nien Wang, New Taipei (TW)

(73) Assignee: Hon Hai Precision Industry Co., Ltd., New Taipei (TW)

( * ) Notice: Subject to any disclaimer, the term of this patent is extended or adjusted under 35 U.S.C. 154(b) by 154 days.

(21) Appl. No.: 13/181,641

(22) Filed: Jul. 13, 2011

(65) Prior Publication Data

US 2012/0162531 A1 Jun. 28, 2012

(30) Foreign Application Priority Data

Dec. 24, 2010 (TW) ..... 99145943 A

(51) Int. Cl.
*H04N 5/38* (2006.01)
*H04N 5/44* (2011.01)
*H04N 5/46* (2006.01)

(52) U.S. Cl.
USPC ..... 348/725; 348/723; 348/553; 348/555

(58) Field of Classification Search
USPC ..... 348/723
See application file for complete search history.

(56) References Cited

U.S. PATENT DOCUMENTS 5,479,267 A * 12/1995 Hashimoto ..... 386/291
2006/0238524 A1* 10/2006 Hsieh et al. ..... 345/204
2009/0013372 A1* 1/2009 Oakes et al. ..... 725/139

OTHER PUBLICATIONS

"High-Definition Multimedia Interface Specification 1.3a" Nov. 10, 2006.*

* cited by examiner

*Primary Examiner* — Jefferey Harold
*Assistant Examiner* — Michael Teitelbaum
(74) *Attorney, Agent, or Firm* — Altis & Wispro Law Group, Inc.

(57) ABSTRACT

A signal transmitting circuit includes a HDMI signal transmitting unit adapted to output a HDMI signal, a VGA signal transmitting unit adapted to output a VGA signal, a VGA signal processing unit, and a transmitting control unit. The VGA signal processing unit is connected to the VGA signal transmitting unit. The VGA signal processing unit is adapted to receive the VGA signal from the VGA signal transmitting unit, and include a detection signal into the VGA signal to form a combination signal. A transmitting control unit is connected to the VGA signal processing unit and the HDMI signal transmitting unit. The transmitting control unit is adapted to receive the combination signal and the VGA signal, to distinguish the combination signal and the VGA signal, and to output the combination signal and the VGA signal to the appropriate receivers.

6 Claims, 2 Drawing Sheets

HDMI AND VGA COMPATIBLE INTERFACE CIRCUIT

BACKGROUND

1. Technical Field

The present disclosure relates to an interface circuit, and more particularly to a HDMI and VGA compatible interface circuit.

2. Description of Related Art

In computer or media systems having a source unit coupled to a display device by a cable, a video output is provided to the display device. One known technique for providing video output to the display device is to use one VGA ("Video Graphics Array") cable and pair of connectors to couple analog video signals and associated video timing signals from the source unit to the display device. Another known technique for providing video output at the location of the display device is to follow the HDMI ("High-Definition Multimedia Interface") standard. Compared to VGA standard, the HDMI standard also can transmit audio signals. For a conventional electronic apparatus, the VGA connector and the HDMI connector are, both from the physical point of view and as a matter of protocol, different standards. The expense of including both types of connection (VGA and HDMI) is high, and a more expedient arrangement is desirable.

Therefore, there is room for improvement within the art.

BRIEF DESCRIPTION OF THE DRAWINGS

Many aspects of the embodiments can be better understood with references to the following drawings. The components in the drawings are not necessarily drawn to scale, the emphasis instead being placed upon clearly illustrating the principles of the embodiments. Moreover, in the drawings, like reference numerals designate corresponding parts throughout the several views.

DETAILED DESCRIPTION

The disclosure is illustrated by way of example and not by way of limitation in the figures of the accompanying drawings in which like references indicate similar elements. It should be noted that references to "an" or "one" embodiment in this disclosure are not necessarily to the same embodiment, and such references mean at least one.

Figure 1:
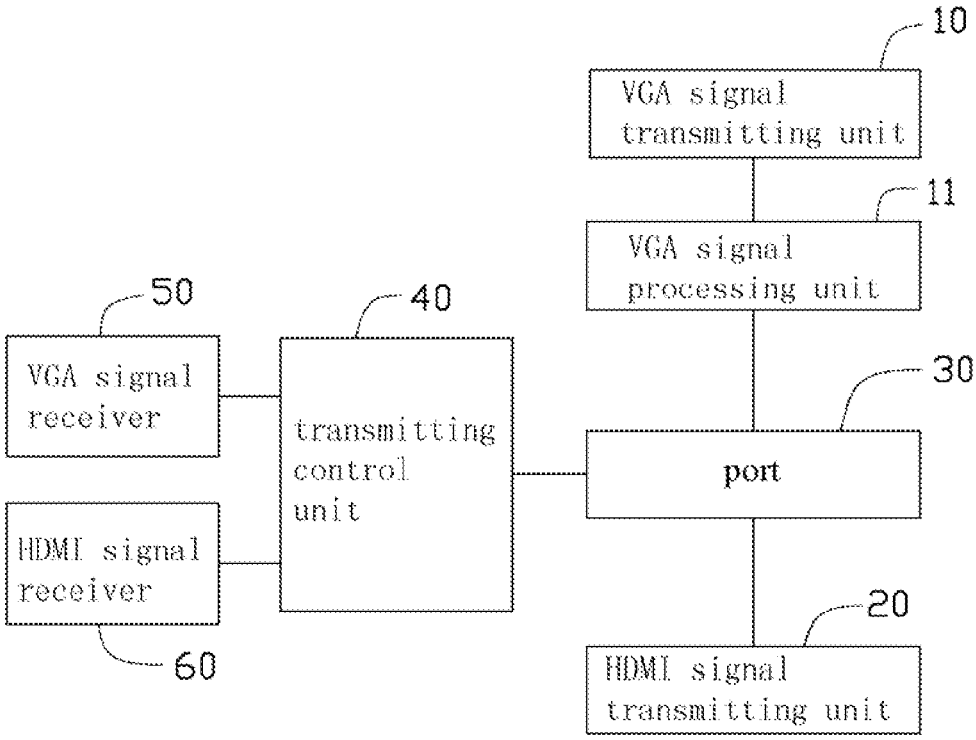
FIG. 1 is a block diagram of an embodiment of a HDMI and VGA compatible interface circuit.
Figure 2:
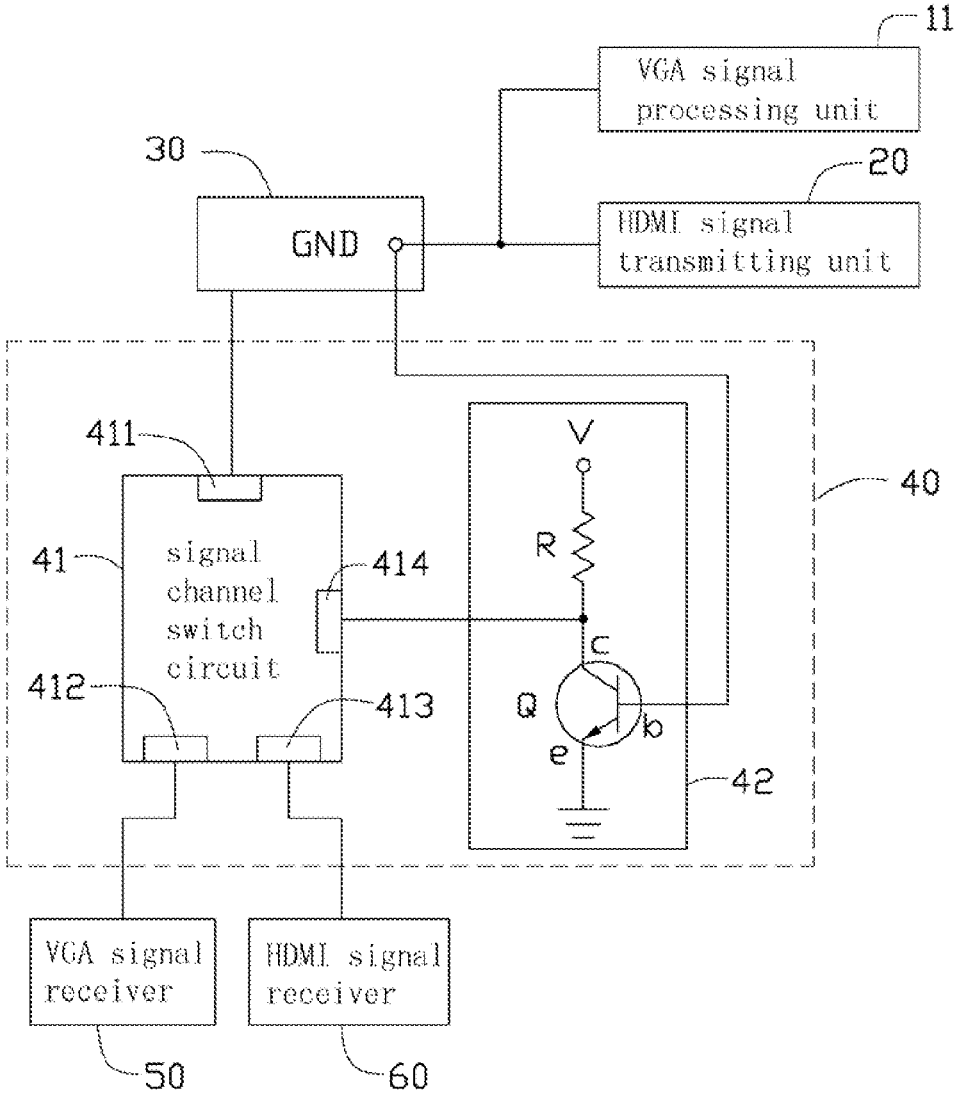
FIG. 2 is another block diagram of the HDMI and VGA compatible interface circuit of FIG. 1.

Referring to FIGS. 1 and 2, a HDMI and VGA compatible interface circuit in accordance with an embodiment includes a VGA signal transmitting unit 10, a HDMI signal transmitting unit 20, a VGA signal processing unit 11, a port 30, a transmitting control unit 40, a VGA signal receiver 50, and a HDMI signal receiver 60. In one embodiment, the port 30 is a conventional HDMI port, which has nineteen pins. According to the HDMI standard, the port 30 has a ground pin GND. In one embodiment, the ground pin GND works as a detection pin. When the port 30 receives a normal HDMI signal, the ground pin GND receives a low level voltage ground signal.

The VGA signal transmitting unit 10 is connected to the VGA signal processing unit 11. The VGA signal transmitting unit 10 transmits VGA signals to the VGA signal processing unit 11. The VGA signal processing unit 11 combines a high level voltage detection signal into the VGA signal to generate a combination signal. The combination signal is transmitted to the port 30. In the combination signal, the high level voltage detection signal is transmitted to the ground pin GND, and VGA signals are transmitted to other pins of the port 30. In one embodiment, the VGA signals are transmitted to fifteen pins of the port 30, which is a smaller number than the total available pins of the port 30.

Referring to FIG. 2, the transmitting control unit 40 includes a signal channel switch circuit 41 and a control circuit 42. The signal channel switch circuit 41 includes an input end 411, a first output end 412, a second output end 413, and a control end 414. The input end 411 is connected to the port 30 to receive signals transmitted from the port 30. The first output end 412 is connected to the VGA signal receiver 50. The second output end 413 is connected to the HDMI signal receiver 60. The control end 414 is connected to the control circuit 42. When the control end 414 is outputting a high level voltage, the signal channel switch circuit 41 links the input end 411 to the second output end 413, and the first output end 412 is turned off. When the control end 414 is outputting a low level voltage, the signal channel switch circuit 41 links the input end 411 to the first output end 412, and the second output end 413 is turned off.

The control circuit 42 includes an on-off Q. In one embodiment, the on-off

Q is a NPN type transistor. A control pin (the base) of the on-off Q is connected to the ground pin GND of the port 30. A first linking pin (the collector) of the on-off Q is connected to the a voltage source V via a resistor R. A first linking pin is also connected to the control end 414. A second linking pin (the emitter) of the on-off Q is connected to ground.

The HDMI and VGA compatible interface circuit works as follows. As the HDMI signal transmitting unit 20 is transmitting HDMI signals to the port 30, the ground pin GND receives a low level voltage ground signal to turn off the on-off Q. Thus, the control end 414 is in high level voltage. The input end 411 and the second output end 413 are linked. HDMI signals are transmitted to the HDMI signal receiver 60.

If the VGA signal transmitting unit 10 is transmitting VGA signals to the port 30, the ground pin GND receives the high level voltage detection signal to turn on the on-off Q. Thus, the control end 414 is in low level voltage. The input end 414 and the first output end 412 are linked. VGA signals are transmitted to the VGA signal receiver 50.

It is to be understood, however, that even though numerous characteristics and advantages of the embodiments have been set forth in the foregoing description, together with details of the structure and functions of the embodiments, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A signal transmitting circuit, comprising:

a HDMI signal transmitting unit adapted to output a HDMI signal;

a VGA signal transmitting unit adapted to output a VGA signal;

a VGA signal processing unit connected to the VGA signal transmitting unit, the VGA signal processing unit adapted to receive the VGA signal from the VGA signal transmitting unit, and combine a detection signal to the VGA signal to form a combination signal; and a transmitting control unit connected to the VGA signal processing unit and the HDMI signal transmitting unit, the transmitting control unit adapted to receive the combination signal and the HDMI signal, distinguish the combination signal and the HDMI signal, and respectively output the VGA signal extracted from the joint signal and the HDMI signal to corresponding receivers;

a port, wherein the transmitting control unit is connected to the VGA signal processing unit and the HDMI signal transmitting unit via the port, and the port is adapted to receive the combination signal from the VGA signal processing unit or receive the HDMI signal; the transmitting control unit comprises a signal channel switch circuit, the signal channel switch circuit comprises an input end, a first output end, and a second output end, the input end is connected to the port, and the first output end is adapted to connected to a VGA signal receiver, and the second output end is adapted to connected to a HDMI receiver; the transmitting control unit comprises a control circuit, the signal channel switch circuit comprises a control end, the control circuit connected to the control end, the control circuit is adapted to link the input end to the first output end or the second output end; the control circuit comprises an on-off, the on-off comprises a control pin, a first linking pin, and a second linking pin, the first linking pin is connected to the control end, the second linking pin is connected to ground, the control pin is connected to the port, the control pin is adapted to detect a type of a signal received by the port, and the control pin is adapted to turn on or turn off the on-off according to a type of a signal received by the port; wherein the port comprises a detection pin, the detection pin is connected to the control pin, the detection pin is adapted to receive a low level voltage ground signal when the port receives the HDMI signal, the detection signal is a high level voltage signal, and the detection pin is adapted to receive the detection signal when the port receives the combination signal.

2. The signal transmitting circuit of claim 1, wherein the port comprises a detection pin, the detection pin is adapted to receive a low level voltage ground signal when the port receives the HDMI signal.

3. The signal transmitting circuit of claim 1, wherein the detection signal is a high level voltage signal, and the detection pin is adapted to receive the detection signal when the port receives the combination signal.

4. A HDMI and VGA compatible interface circuit, comprising:

a VGA signal processing unit, the VGA signal processing unit adapted to receive a VGA signal, and combine a detection signal to the VGA signal to form a combination signal;

a port connected to VGA signal processing unit, the port adapted to receive the combination signal from the VGA signal processing unit or receive a HDMI signal; and a transmitting control unit connected to the port, the transmitting control unit adapted to detect a type of a signal received by the port, and adapted to transmit the signal received by the port to corresponding apparatus;

wherein the transmitting control unit comprises a signal channel switch circuit, the signal channel switch circuit comprises an input end, a first output end, and a second output end, the input end is connected to the port, and the first output end is adapted to connected to a VGA signal receiver, and the second output end is adapted to connected to a HDMI receiver; the transmitting control unit comprises a control circuit, the signal channel switch circuit comprises a control end, the control circuit connected to the control end, the control circuit is adapted to link the input end to the first output end or the second output end; the control circuit comprises an on-off, the on-off comprises a control pin, a first linking pin, and a second linking pin, the first linking pin is connected to the control end, the second linking pin is connected to ground, the control pin is connected to the port, the control pin is adapted to detect a type of a signal received by the port, and the control pin is adapted to turn on or turn off the on-off according to a type of a signal received by the port; the port comprises a detection pin, the detection pin is connected to the control pin, the detection pin is adapted to receive a low level voltage ground signal when the port receives the HDMI signal, the detection signal is a high level voltage signal, and the detection pin is adapted to receive the detection signal when the port receives the combination signal.

5. The HDMI and VGA compatible interface circuit of claim 4, wherein the port comprises a detection pin, the detection pin is adapted to receive a low level voltage ground signal when the port receives the HDMI signal.

6. The HDMI and VGA compatible interface circuit of claim 5, wherein the detection signal is a high level voltage signal, and the detection pin is adapted to receive the detection signal when the port receives the combination signal.

* * * * *